US009033482B2

(12) United States Patent
Agarwal et al.

(10) Patent No.: US 9,033,482 B2
(45) Date of Patent: May 19, 2015

(54) FLUID DISPENSER

(75) Inventors: Arun Agarwal, Corvallis, OR (US); Paul Richards, Corvallis, OR (US); Galen Cook, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,117

(22) PCT Filed: Feb. 21, 2012

(86) PCT No.: PCT/US2012/025925
§ 371 (c)(1), (2), (4) Date: Jul. 23, 2014

(87) PCT Pub. No.: WO2013/126045
PCT Pub. Date: Aug. 29, 2013

(65) Prior Publication Data
US 2014/0354741 A1 Dec. 4, 2014

(51) Int. Cl.
*B41J 2/175* (2006.01)
*B41J 2/05* (2006.01)
*B41J 2/14* (2006.01)

(52) U.S. Cl.
CPC ..... *B41J 2/17563* (2013.01); *B41J 2/14016* (2013.01); *B41J 2002/14387* (2013.01); *B41J 2002/14403* (2013.01)

(58) Field of Classification Search
USPC ..... 347/65, 87, 93
See application file for complete search history.

(56) References Cited

U.S. PATENT DOCUMENTS

| | | | | |
|---|---|---|---|---|
| 6,086,195 | A | 7/2000 | Bohorquez et al. | |
| 6,254,229 | B1 * | 7/2001 | Bohorquez et al. | 347/93 |
| 6,264,309 | B1 | 7/2001 | Sullivan | |
| 6,520,632 | B1 | 2/2003 | Yamazaki et al. | |
| 6,814,435 | B1 | 11/2004 | Shimada et al. | |
| 6,896,360 | B2 | 5/2005 | Cox et al. | |
| 7,273,275 | B2 | 9/2007 | Buchanan et al. | |
| 7,287,847 | B2 * | 10/2007 | Fujii et al. | 347/93 |
| 7,819,514 | B2 | 10/2010 | Uezawa | |
| 7,862,158 | B2 | 1/2011 | Fujii et al. | |
| 7,901,064 | B2 * | 3/2011 | Urayama et al. | 347/93 |
| 8,201,928 | B2 * | 6/2012 | Gerner et al. | 347/71 |
| 2005/0062814 | A1 | 3/2005 | Yildirim et al. | |
| 2007/0064060 | A1 | 3/2007 | Gu et al. | |

OTHER PUBLICATIONS

International Search Report and Written Opinion for International Application No. PCT/US2012/025925 dated Oct. 19, 2012, 10 pp.

* cited by examiner

*Primary Examiner* — Anh T. N. Vo
(74) *Attorney, Agent, or Firm* — Hewlett-Packard Patent Department

(57) ABSTRACT

A fluid dispenser is disclosed herein. An example of such a fluid dispenser includes a housing configured to store a quantity of fluid and an ejection assembly configured to controllably emit the fluid through a nozzle. The fluid dispenser also includes a fluid chamber configured both to supply a quantity of the fluid to the ejection assembly and to define a fluid flow path between the housing and the ejection assembly. The fluid dispenser further includes a filter positioned in the fluid flow path and configured both to conduct the fluid from the housing to the fluid chamber and to restrain particles in the fluid from entering the fluid chamber. The filter is further configured to define a bubble flow path that facilitates conduction of bubbles from the fluid chamber to the housing. Additional features of this fluid dispenser are disclosed herein, as are other examples of fluid dispensers.

23 Claims, 5 Drawing Sheets

FLUID DISPENSER

BACKGROUND

A challenge exists to deliver quality and value to consumers, for example, by providing reliable products that are cost effective. Further, businesses may desire to enhance the performance of their products, for example, by increasing the speed and accuracy of the functioning of one or more components of such products.

BRIEF DESCRIPTION OF THE DRAWINGS

The following detailed description references the drawings, wherein.

DETAILED DESCRIPTION

Reliability of fluid dispensers, such as inkjet printheads used in printing devices, is desirable. Quality of fluid dispenser output (e.g., print resolution) is also desirable. Accuracy of fluid dispenser output (e.g., droplet placement), is also a design consideration.

Figure 1:
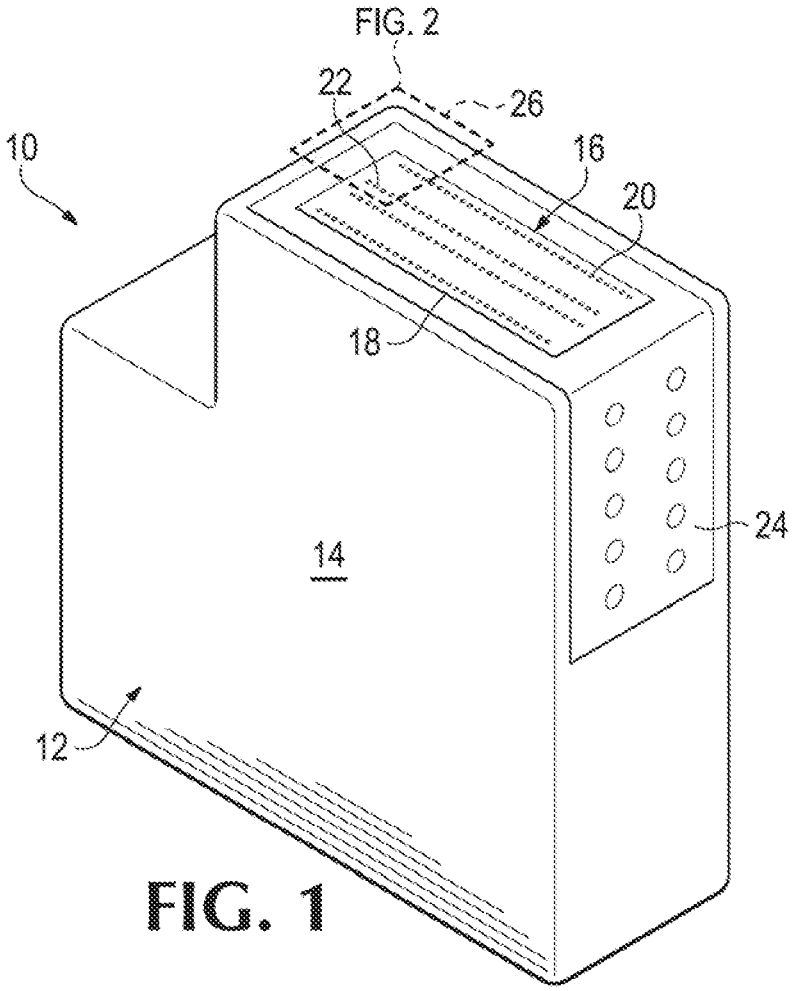
FIG. 1 shows a perspective view of an example of a fluid dispenser.

An example of a fluid dispenser 10 is shown in FIG. 1. As can be seen in FIG. 1, this example of fluid dispenser 10 is a print cartridge 12. Print cartridge 12 includes a housing or supply 14 that is configured to store a quantity of fluid (not shown in FIG. 1). Print cartridge 12 of fluid dispenser 10 also includes an ejection assembly or electrical device 16 configured to controllably emit one or more droplets of fluid. In this example, ejection assembly or electrical device 16 is configured to include a printhead 18. Printhead 18 includes a plurality of nozzles 20 and 22 through which the droplets of fluid (in this case ink) are emitted or ejected. As can also be seen in FIG. 1, print cartridge 12 additionally includes an electrical interconnect 24 that conveys control signals to electrical device or ejection assembly 16 that are received from a printing device (not shown) having a corresponding electrical interconnect (also not shown) in which print cartridge 12 is disposed. These control signals regulate which nozzles 20 and 22 eject droplets of ink.

Figure 2:
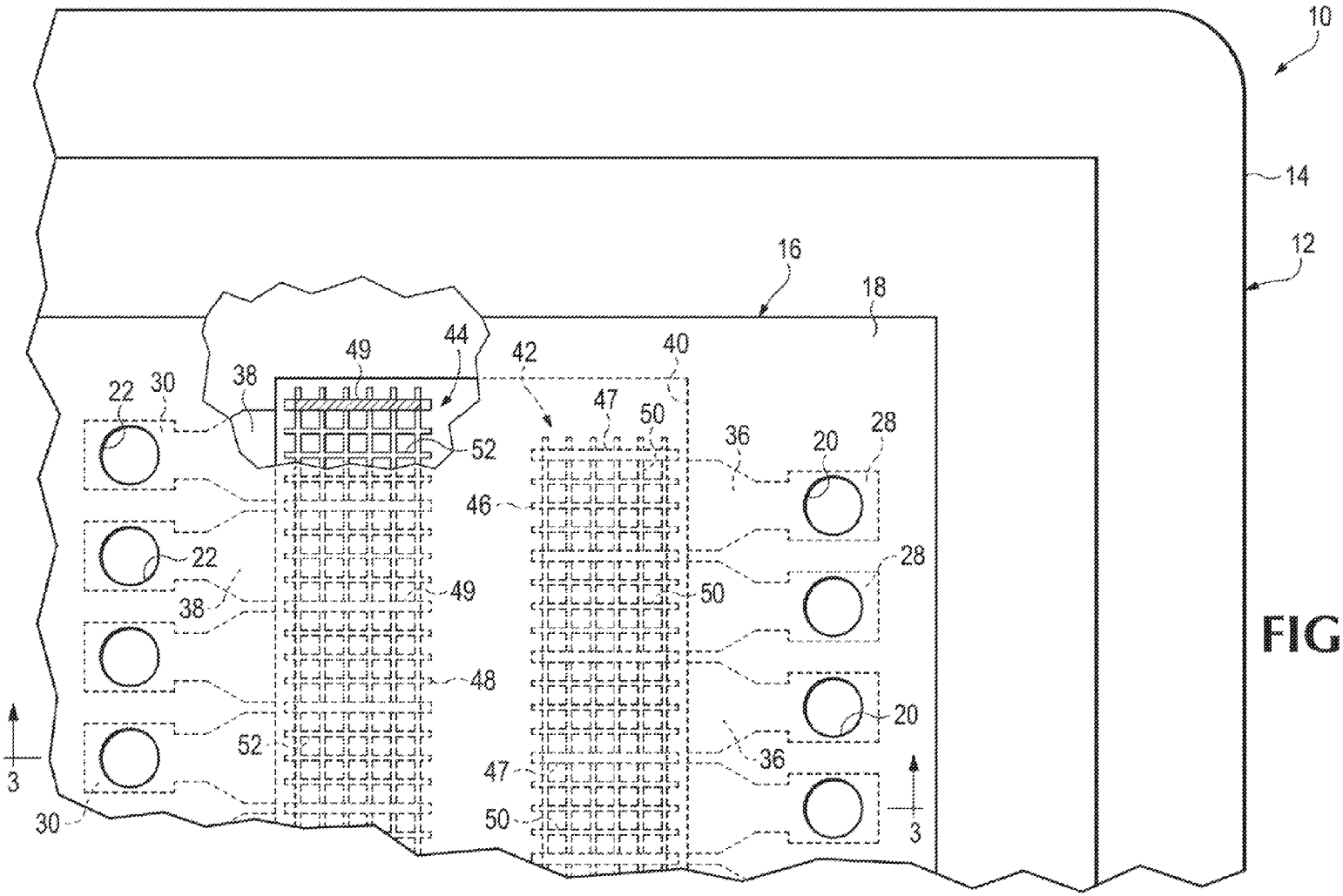
FIG. 2 is an enlarged view of a portion of the example of the fluid dispenser within the dashed area shown in FIG. 1.

FIG. 2 shows an enlarged view of a portion of fluid dispenser 10 within dashed area 26 of FIG. 1. As can be seen in FIG. 2, printhead 18 of ejection assembly or electrical device 16 includes the above-described plurality of nozzles 20 and 22 each of which fluidly communicates with a respective firing chamber 28 and 30 in which a resistive element 32 or 34 (see, e.g., FIG. 3) is disposed. Referring again to FIG. 2, printhead 18 of fluid dispenser 10 additionally includes fluid chambers 36 which supply fluid from slot 40 to firing chambers 28 and resistive elements 32. Printhead 18 of fluid dispenser 10 also includes fluid chambers 38 which supply fluid from slot 40 to firing chambers 30 and resistive elements 34. Slot 40 is coupled to housing or supply 14 and conveys the stored fluid to chambers 36 and 38.

Fluid dispenser 10 further includes filters or plates 42 and 44. As discussed more fully below, filters or plates 42 and 44 are configured both to conduct fluid from housing or supply 14 to respective fluid chambers 36 and 38 and to restrain particles in the fluid from entering fluid chambers 36 and 38. As also discussed more fully below, filters or plates 42 and 44 are further configured to define a bubble flow path that facilitates conduction of bubbles from fluid chambers 36 and 38 toward housing or supply 14. In the example illustrated in FIG. 2, filters or plates 42 and 44 are configured to include respective mesh assemblies 46 and 48. As can be seen in FIG. 2, mesh assemblies 46 and 48 are each configured to respectively define a plurality of apertures or openings 50 and 52.

Figure 3:
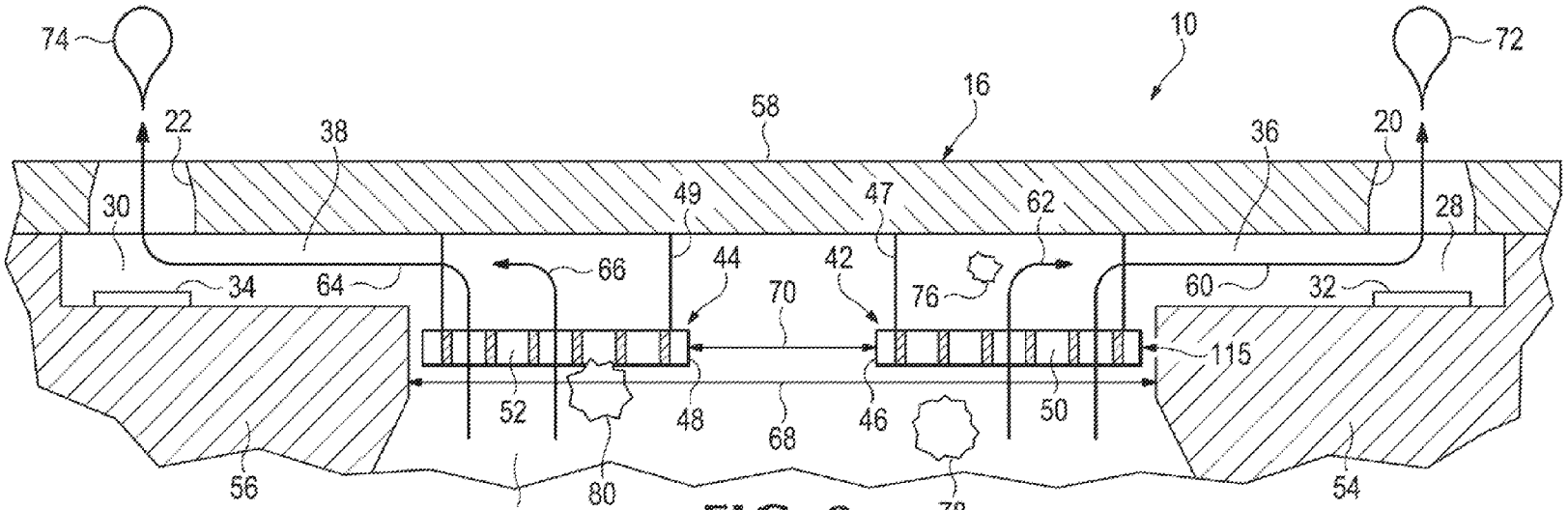
FIG. 3 is a cross-sectional view of the example of the fluid dispenser taken along line 3-3 of FIG. 2.

FIG. 3 is a cross-sectional view of fluid dispenser 10 taken along line 3-3 of FIG. 2. As can be seen in FIG. 3, walls 54 and 56 of fluid dispenser 10 in combination with nozzle or orifice plate 58 define fluid chambers 36 and 38, as well as a fluid flow path, indicated by arrows 60, 62, 64, and 66, that conveys fluid from housing or supply 14, through the fluid passageways of apertures or openings 50 and 52, to electrical device or ejection assembly 16. As indicated by arrows 60 and 64, the fluid continues to travel within fluid chambers 36 and 38 toward respective firing chambers 28 and 30. Resistive elements 32 and 34 may then be energized to heat the fluid within respective firing chambers 28 and 30 which will cause droplets 72 and 74 to be emitted from respective nozzles 20 and 22.

As can also be seen in FIG. 3, filters or plates 42 and 44 are suspended from nozzle or orifice plate 58 by support walls 47 and 49 so as to extend across a portion of a total width 68 of the fluid flow paths can additionally be seen in FIG. 3, mesh assemblies 46 and 48 of filters or plates 42 and 44 are each configured to have dimensions such that they extend across less than total width 68 of the fluid flow path, thereby defining an open portion 70 in total width 68 of the fluid flow path. As discussed in more detail below, open portion 70 of fluid dispenser 10 is designed to facilitate conveyance of bubbles in the fluid away from ejection assembly or electrical device 16 to housing or supply 14.

Depending upon the characteristics of the fluid within supply or housing 14 and ambient conditions, such as temperature, humidity, dust, dirt, pressure, etc., particles or agglomerations 76, 78, and 80 of various sizes and shapes may be present or may form within the fluid. If particles 76, 78, and 80 of a sufficient size or quantity are allowed flow into fluid chambers 36 and 38 or firing chambers 28 and 30, they may partially block or clog them, preventing sufficient fluid from entering. In worst cases, such particles 76, 78, and 80 may completely block or clog them, preventing any fluid from entering. Both of these scenarios degrade the performance and reliability of fluid dispenser 10 and can result in a complete malfunction, requiring replacement. Such particles 76, 78, and 80 may also partially clog or block nozzles 20 and 22 causing droplets 72 to 74 to be misdirected or of incorrect dimensions which also compromises the reliability and accuracy of fluid dispenser 10. In worst cases, such particles 76, 78, and 80 may completely block or clog nozzles 20 and 22, preventing ejection of any droplets which can require replacement of fluid dispenser 10.

Each of mesh assemblies 46 and 48 of filters or plates 42 and 44 are configured to restrain particles in the fluid, such as particles or agglomerations 78 and 80, from entering fluid chambers 36 and 38 or other parts of ejection assembly or electrical device 16, as discussed above. Each of mesh assemblies 46 and 48 of filters or plates 42 and 44 are additionally configured to maintain an adequate fluid flow rate from housing or supply 14 to fluid chambers 36 and 38 and respective firing chambers 28 and 30. This helps ensure that resistive elements 32 and 34 have a sufficient quantity of fluid to eject droplets 72 and 74 at a rate which helps maintain the desired printing speed of printhead 18 of print cartridge 12. Both of these objectives are accomplished by configuring mesh assemblies 46 and 48 of filters or plates 42 and 44 to define openings or apertures 50 and 52 to have a predetermined geometry designed to restrain particles, such as particles or agglomerations 78 and 80, from entering electrical device or ejection assembly 16 and rendering it inoperable (either partially or completely), as described above, while still permitting a sufficient quantity of the actual fluid to still flow through apertures or openings 50 and 52. It should be noted that mesh assemblies 46 and 48 may not restrain all particles, such as particle or agglomeration 76, from entering electrical device or ejection assembly 16 because the predetermined geometry of openings or apertures 50 and 52 is configured to be larger than that of some particles, such as particle or agglomeration 76. However, such particles are of an insufficient size to block fluid chambers 36 and 38, firing chambers 28 and 30, or nozzles 20 and 22. Instead, they are either ejected out of nozzles 20 and 22 or dissolved within the fluid in which they are suspended.

In the example shown in FIG. 3, walls 54 and 56, nozzle or orifice plate 58, and filters or plates 42 and 44 may be made from readily available materials utilizing conventional manufacturing processes. For example, photo defined spin on coatings such as SU8. Resistive elements 32 and 34 may be made from common Thermal Inkjet films such as WSiN or TaAl. Resistive elements 32 and 34 are secured within respective firing chambers 28 and 30 by conventional integrated circuit manufacturing and fabrication processes that cycle through material deposition followed by patterning and etching.

Figure 4:
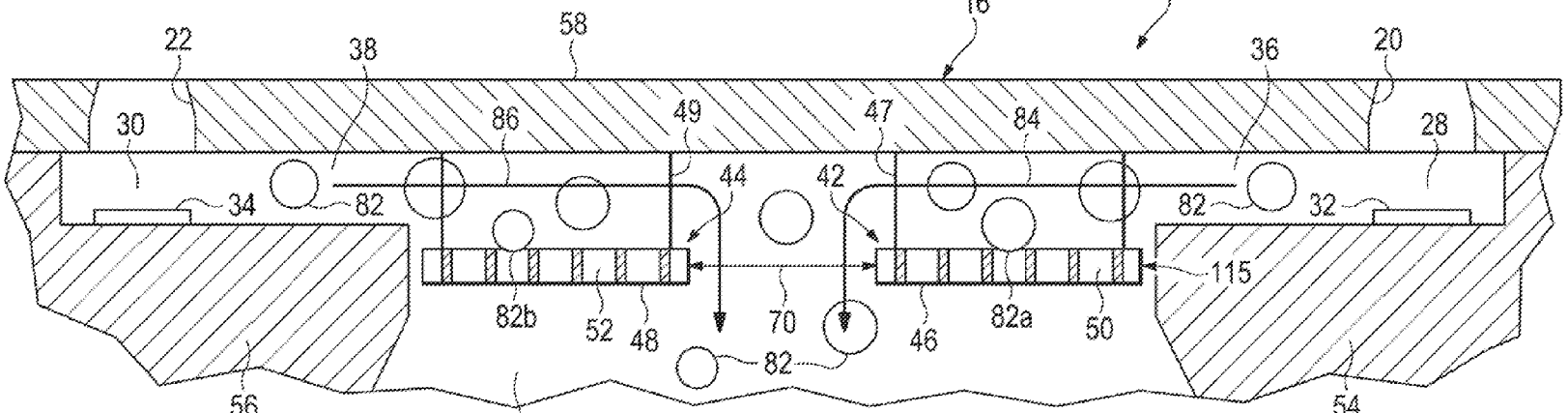
FIG. 4 is the cross-sectional view of the example of the fluid dispenser of FIG. 3 with bubbles added and fluid flow and particles removed.

FIG. 4 is a cross-sectional view of the example of the fluid dispenser of FIG. 3 with fluid flow and particles removed, for purposes of clarity, and bubbles 82 added. Bubbles 82 in the fluid can arise as a result of energizing of resistive elements 32 and 34 and ejection of droplets 72 and 74. Bubbles 82 in the fluid can also result from changes in ambient pressure or temperature of the environment in which fluid dispenser 10 is used. Bubbles 82 may also occur if the fluid in supply or housing 14 is agitated. Bubbles 82 can inhibit the flow of fluid from housing or supply 14 to electrical device or ejection assembly 16 by blocking the fluid flow path (as generally indicated by arrows 60, 62, 64 and 66 in FIG. 3) and should be removed. Otherwise, one or more of nozzles 20 and 22 may no longer emit droplets 72 and 74 due to a lack of a supply of fluid. This can result in damage to resistive elements 32 and 34 due to overheating and potentially render fluid dispenser 10 inoperable.

Referring again to FIG. 4, mesh assemblies 46 and 48 of filters or plates 42 and 44 are additionally configured to facilitate conveyance of bubbles 82 from ejection chambers 28 and 30 and fluid chambers 36 and 38 of electrical device or ejection assembly 16 toward supply or housing 14. As can be seen in FIG. 4, this is accomplished, in part, by configuring apertures or openings 50 and 52 defined by mesh assemblies 46 and 48 of filters or plates 42 and 44 to have a predetermined geometry designed to restrain bubbles 82 from passing through, such as bubbles 82*a* and 82*b* (which are larger than openings or apertures 50 and 52). Instead, mesh assemblies 46 and 48 of filters or plates 42 and 44 help to define a bubble flow path, indicated by arrows 84 and 86 that facilitates conduction of bubbles 82 across mesh assemblies 46 and 48 and through open portion 70 away from ejection assembly or electrical device 16 and toward housing or supply 14. Bubbles 82 that are smaller than openings or apertures 50 and 52 may additionally flow through apertures or openings 50 and 52 defined by mesh assemblies 46 and 48 of filters or plates 42 and 44.

Figure 5:
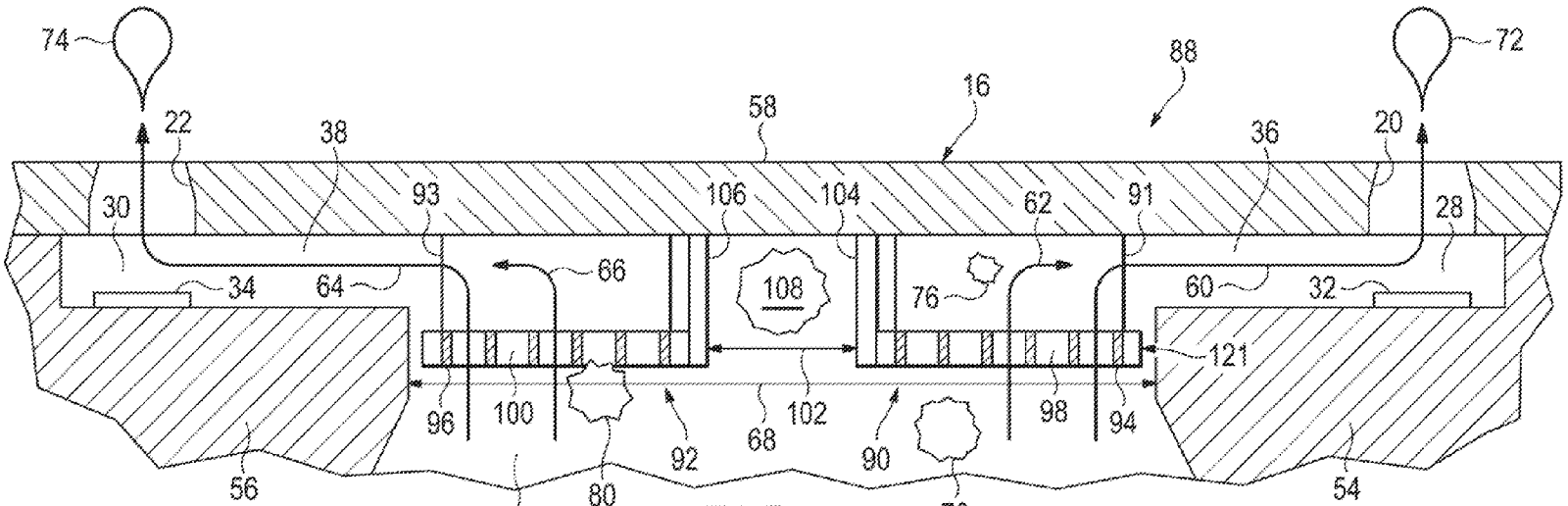
FIG. 5 is a cross-sectional view of another example of a fluid dispenser.

A cross-sectional view of another example of to fluid dispenser 88 is shown in FIG. 5. In this example, those elements and the functioning of fluid dispenser 10 that remain the same for fluid dispenser 88 retain the same reference numerals as those used in FIGS. 1-4. Additionally, particles 76, 78, and 80 and bubbles 82 retain the same reference numerals. As can be seen in FIG. 5, fluid dispenser 88 includes different filters or plates 90 and 92. Filters or plates 90 and 92 are configured both to conduct fluid from housing or supply 14 to respective fluid chambers 36 and 38 and to restrain particles 78 and 80 in the fluid from entering fluid chambers 36 and 38, as discussed above. Additionally, filters or plates 90 and 92 are further configured to define a bubble flow path that facilitates conduction of bubbles 82 from fluid chambers 36 and 38 toward housing or supply 14, as discussed more fully below. Filters or plates 90 and 92 are configured to include respective mesh assemblies 94 and 96. As can be seen in FIG. 5, mesh assemblies 94 and 96 are each configured to respectively define a plurality of apertures or openings 98 and 100. Apertures or openings 98 and 100 provide fluid passageways through which fluid may flow from housing or supply 14 to electrical device or ejection assembly 16, as indicated by arrows 60, 62, 64, and 66.

As can also be seen in FIG. 5, filters or plates 90 and 92 are suspended from nozzle or orifice plate 58 by support walls 91 and 93 so as to extend across a portion of the total width 68 of the fluid flow path. As can additionally be seen in FIG. 5, mesh assemblies 94 and 96 of filters or plates 90 and 92 are each configured to have dimensions such that they extend across less than total width 68 of the fluid flow path, thereby defining an open portion 102 in total width 68 of the fluid flow path. Open portion 102 of fluid dispenser 88 has different dimensions than open portion 70 because of back walls 104 and 106 on respective mesh assemblies 94 and 96, discussed in more detail below.

Mesh assemblies 94 and 96 of filters or plates 90 and 92 are configured to restrain particles in the fluid, such as particles or agglomerations 78 and 80, from entering fluid chambers 36 and 38 or other parts of ejection assembly or electrical device 16, as discussed above. This is accomplished by configuring mesh assemblies 94 and 96 of filters or plates 90 and 92 to define openings or apertures 98 and 100 to have a predetermined geometry designed to restrain particles, such as particles or agglomerations 78 and 80, from entering electrical device or ejection assembly 16 and rendering it inoperable (either partially or completely), as described above, while still permitting a sufficient quantity of the actual fluid to flow through apertures or openings 98 and 100. It should be noted that mesh assemblies 94 and 96 may not restrain all particles, such as particle or agglomeration 76, from entering electrical device or ejection assembly 16 because the predetermined geometry of openings or apertures 98 and 100 is configured to be larger than that of some particles, such as particle or agglomeration 76. However, such particles are of an insufficient size to block fluid chambers 36 and 38, firing chambers 28 and 30, or nozzles 20 and 22. Instead, they are either ejected out of nozzles 20 and 22 or dissolved within the fluid in which they are suspended.

In some cases, larger particles such as particle 108 may pass through open portion 102 towards fluid chambers 36 and 38. To help alleviate this from occurring, mesh assemblies 94 and 96 of filters or plates 90 and 92 are configured to include back walls 104 and 106 which are designed to block larger particles, such as particle 108, and help prevent them from dogging fluid chambers 36 and 38. In other examples, back walls 104 and 106 may be differently sized than as illustrated in FIG. 5, depending upon the range of sizes of particles likely to be present or to arise within the fluid stored in supply or housing 14.

Figure 6:
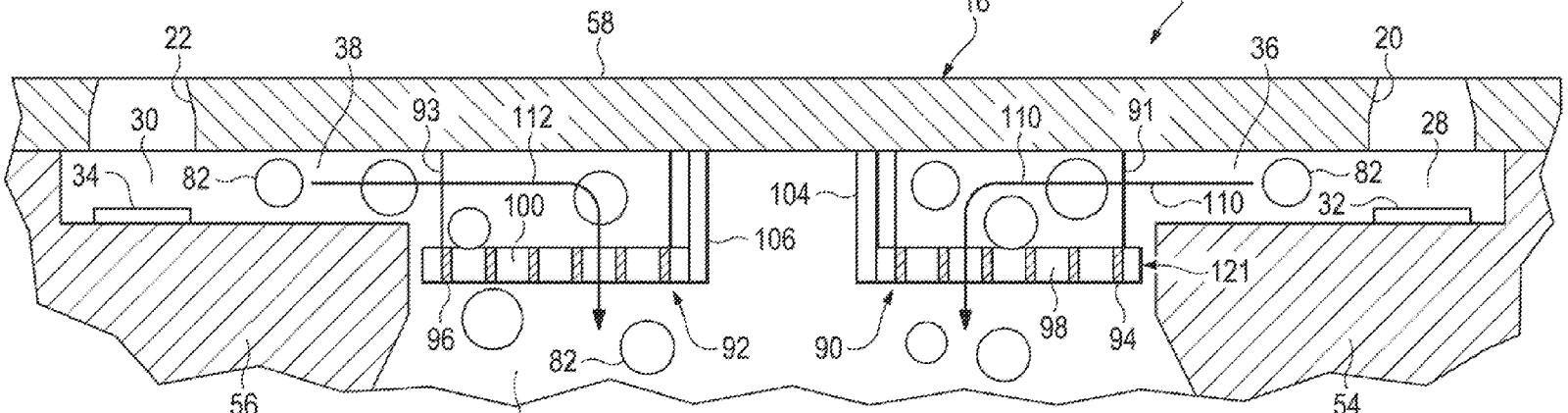
FIG. 6 is a cross-sectional view of the example of the fluid dispenser of FIG. 5 with bubbles added and fluid flow and particles removed.

FIG. 6 is a cross-sectional view of the example of the fluid dispenser of FIG. 5 with fluid flow and particles removed, for purposes of clarity, and bubbles 82 added. Mesh assemblies 94 and 96 of filters or plates 90 and 92 are additionally configured to facilitate conveyance of bubbles 82 from ejection chambers 28 and 30 and fluid chambers 36 and 38 of electrical device or ejection assembly 16 toward supply or housing 14. As can be seen in FIG. 6, this is accomplished, in part, by configuring apertures or openings 98 and 100 defined by mesh assemblies 94 and 96 of filters or plates 90 and 92 to have a predetermined geometry designed to facilitate passing of bubbles 82 across and through them, as indicated by arrows 110 and 112 in FIG. 6, away from ejection assembly or electrical device 16 and toward housing or supply 14. This design may require apertures or openings 98 and 100 to be larger than apertures or openings 50 and 52 defined by mesh assemblies 46 and 48 of filters or plates 42 and 44 in order to allow for a sufficient quantity of bubbles 82 to be conveyed toward housing or supply 14. Alternatively or additionally, bubble 82 growth and size can be restricted through the use of additional walls that physically limit how large bubbles 82 may get in one or more dimensions. This is due to the fact that bubbles 82 may not always be substantially spherical as illustrated. Rather, bubbles 82 will form whatever size and shape has the lowest energy (largest radius of curvature).

Figure 7:
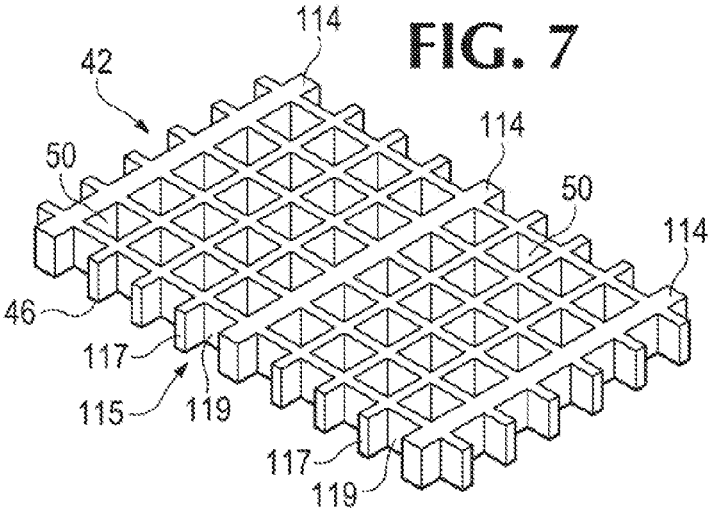
FIG. 7 is an enlarged perspective view of an example of a filter or plate.

An enlarged perspective view of an example of a falter or plate 42 is shown in FIG. 7. Although not shown in FIG. 7, it is to be understood that filter or plate 44 has the same configuration as filter or plate 42. It is to also be understood that the following description of filter or plate 42 is applicable to filter or plate 44 as well. As can be seen in FIG. 7, filter or plate 42 includes a plurality of mesh assemblies 46 that are configured to define the above-described apertures or openings 50. As can also be seen in FIG. 7, apertures or openings 50 are substantially identical and also substantially rectangular. As can additionally be seen in FIG. 7, filter or plate 42 is configured to include support walls 114 to which the above-described support walls 47 are attached to suspend mesh assemblies 46 of filter or plate 42 from nozzle or orifice plate 58. In at least one example of filter or plate 42, the number of mesh assemblies 46 is in a one-to-one correspondence to the number of nozzles 20. This one-to-one correspondence helps to prevent a chain reaction of "nozzle-outs." Should one mesh assembly 46 fail, only that nozzle to which it is paired will be potentially affected.

As can also be seen in FIG. 7, each of mesh assemblies 46 of filter or plate 42 is additionally configured to include crenellations 115 positioned adjacent wall 54 as shown in FIGS. 3 and 4. Referring again to FIG. 7, crenellations 115 are configured to include merlons 117 that help to restrict particle flow into fluid chamber 36 and firing chamber 28. Crenellations 115 are additionally configured to define crenels 119 that facilitate fluid flow into fluid chamber 36 and firing chamber 28.

Figure 8:
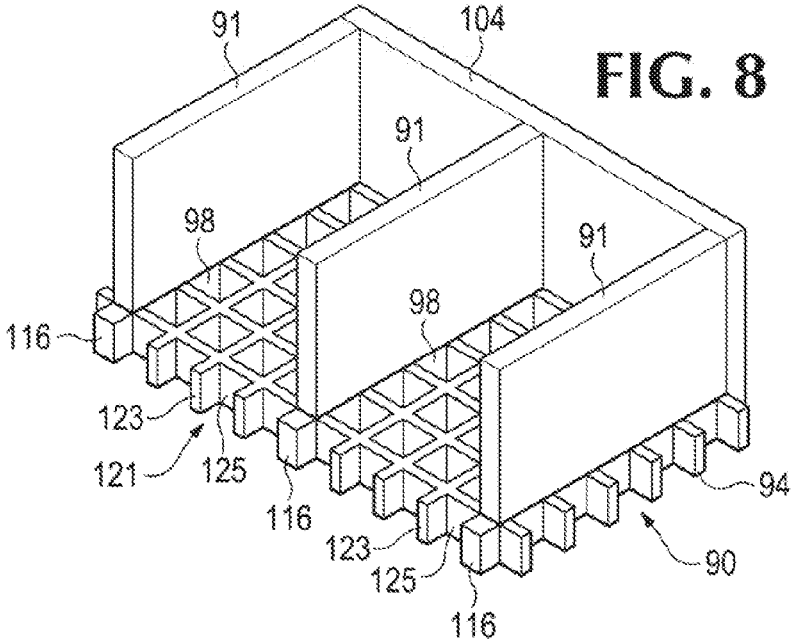
FIG. 8 is an enlarged perspective view of another example of a filter or plate.

An enlarged perspective view of another example of a filter or plate 90 is shown in FIG. 8. Although not shown in FIG. 8, it is to be understood that filter or plate 92 has the same configuration as filter or plate 90. It is to also be understood that the following description of filter or plate 90 is applicable to filter or plate 92 as well. As can be seen in FIG. 8, filter or plate 90 includes a plurality of mesh assemblies 94 that are configured to define the above-described apertures or openings 98. As can also be seen in FIG. 8, apertures or openings 98 are substantially identical and also substantially rectangular. As can additionally be seen in FIG. 8, filter or plate 90 is configured to include support walls 116 to which the above-described support walls 91 are attached to suspend mesh assemblies 94 of filter or plate 90 from nozzle or orifice plate 58. As can further be seen in FIG. 8, mesh assemblies 94 of filter or plate 90 are additionally configured to include the above-described back wall 104. In at least one example of filter or plate 90, the number of mesh assemblies 94 is in a one-to-one correspondence to the number of nozzles 20. This one-to-one correspondence helps to prevent a chain reaction of "nozzle-outs." Should one mesh assembly 94 fail, only that nozzle to which it is paired will be potentially affected.

As can also be seen in FIG. 8, each of mesh assemblies 94 of filter or plate 90 is additionally configured to include crenellations 121 positioned adjacent wall 54 as shown in FIGS. 5 and 6. Referring again to FIG. 8, crenellations 121 are configured to include merlons 123 that help to restrict particle flow into fluid chamber 36 and firing chamber 28. Crenellations 121 are additionally configured to define crenels 125 that facilitate fluid flow into fluid chamber 36 and firing chamber 28.

Figure 9:
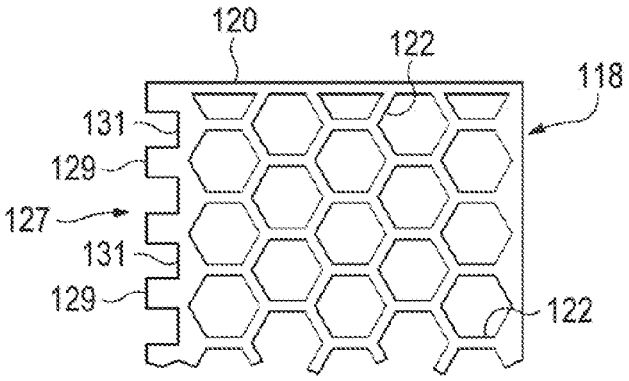
FIG. 9 is a top view of an additional example of a filter or plate.

An enlarged top view of an additional example of a filter or plate 118 is shown in FIG. 9. As can be seen in FIG. 9, filter or plate 118 includes a mesh assembly 120 that is configured to define apertures or openings 122. As can also be seen in FIG. 9, apertures or openings 122 are substantially identical and also substantially hexagonal. Although not shown in FIG. 9, filter or plate 118 may be configured to include support walls, similar or identical to support walls 114 and 116, to which support walls, similar or identical to support walls 47, 49, 91, and 93, may be attached to suspend mesh assembly 120 of filter or plate 118 from nozzle or orifice plate 58. Also, although not shown in FIG. 9, mesh assemblies 120 of filter or plate 118 may additionally be configured to include the above-described back wall 104. In at least one example of filter or plate 118, the number of mesh assemblies 120 is in a one-to-one correspondence to the number of nozzles 20. This one-to-one correspondence helps to prevent a chain reaction of "nozzle-outs." Should one mesh assembly 120 fail, only that nozzle to which it is paired will be potentially affected.

As can also be seen in FIG. 9, each mesh assemblies 120 of filter or plate 118 is additionally configured to include crenellations 127 positioned adjacent walls 54 and 56. Referring again to FIG. 9, crenellations 127 are configured to include merlons 129 that help to restrict particle flow into fluid chambers 36 and 38, as well as respective and firing chambers 28 and 30. Crenellations 127 are additionally configured to define crenels 131 that facilitate fluid flow into fluid chambers 36 and 38, as well as respective and firing chambers 28 and 30.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, although the examples illustrated above relate to inkjet printing, other examples of possible applications include medicine delivery and stereo lithography. As another example, the openings or apertures defined by a mesh assembly can be configured to have different shapes such as substantially square and substantially hexagonal on the same mesh assembly. As an additional example, the openings or apertures defined by a mesh assembly can be different than as illustrated above, such as substantially circular or oval. As a further example, the correspondence between mesh assemblies and nozzles may be other than one-to-one (e.g., two mesh assemblies to one nozzle). As yet a further example, mesh assemblies 46 and 48 of filters or plates 42 and 44 may be attached to respective walls 54 and 56 in addition to or as an alternative to being suspended from nozzle or orifice plate 58 by respective walls 47 and 49. Similarly, mesh assemblies 94 and 96 of filters or plates 90 and 92 may be attached to respective walls 54 and 56 in addition to or as an alternative to being suspended from nozzle or orifice plate 58 by respective walls 91 and 93. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A fluid dispenser, comprising:

a housing configured to store a quantity of fluid;

an ejection assembly configured to controllably emit the fluid through a nozzle;

a fluid chamber configured to supply a quantity of the fluid to the ejection assembly, and further configured to define a fluid flow path between the housing and the ejection assembly; and a filter positioned in the fluid flow path and configured both to conduct the fluid from the housing to the fluid chamber and to restrain particles in the fluid from entering the fluid chamber, and further configured to have dimensions that extend across less than the total width of the fluid flow path thereby defining an open portion in total width of the fluid flow path to define a bubble flow path in the open portion that facilitates conduction of bubbles from the fluid chamber to the housing.

2. The fluid dispenser of claim 1, wherein the ejection assembly further configured to controllably emit the fluid through a plurality of nozzles and wherein the filter is additionally configured to include a separate mesh assembly for each nozzle of the ejection assembly.

3. The fluid dispenser of claim 2, wherein the mesh assembly is configured to define a plurality of openings.

4. The fluid dispenser of claim 3, wherein the openings have a substantially similar shape.

5. The laid dispenser of claim 2, wherein the mesh assembly is configured to include a back wall.

6. The fluid dispenser of claim 2, wherein the mesh assembly is configured to include crenellations.

7. The fluid dispenser of claim 1, in a print cartridge.

8. The fluid dispenser of claim 1, wherein the fluid includes an ink.

9. The fluid dispenser of claim 1, wherein the ejection assembly is further configured to include a resistive element.

10. A fluid dispenser, comprising:

a supply configured to store a quantity of fluid;

an electrical device configured to controllably emit a droplet of the fluid;

a fluid flow path configured to convey the fluid from the supply to the electrical device; and a plate positioned in the fluid flow path between the supply and the electrical device, and configured to have dimensions that extend across less than the total width of the fluid flow path thereby defining an open portion in total width of the fluid flow path to define a bubble flow path in the open portion to convey bubbles in the fluid away from the electrical device to the supply, and the plate to have a plurality of apertures of a predetermined geometry designed to restrain particles in the fluid from rendering the electrical device inoperable.

11. The fluid dispenser of claim 10, wherein the predetermined geometry of the apertures is selected to be one of substantially rectangular and substantially hexagonal.

12. The fluid dispenser of claim 10, wherein the electrical device is further configured with an ejection assembly to controllably emit a plurality of droplets of fluid through a plurality of nozzles and wherein the plate includes a separate mesh assembly for each nozzle of the ejection assembly.

13. The fluid dispenser of claim 12, wherein the mesh assembly is configured to include a back wall.

14. The fluid dispenser of claim 12, wherein the mesh assembly is configured to include crenellations.

15. The fluid dispenser of claim 10, wherein the electrical device is configured to include a printhead.

16. The fluid dispenser of claim 10, wherein the fluid includes an ink.

17. A fluid dispenser, comprising:

an ejection assembly configured to controllably emit droplets of a fluid through a plurality of nozzles;

a fluid flow path having a total width and configured to convey the fluid to the ejection assembly; and a separate mesh assembly for each nozzle of the ejection assembly, each mesh assembly positioned across a different portion of the total width of the fluid flow path and each mesh assembly being configured to have dimensions such that the mesh assemblies extend across less than the total width of the fluid flow path thereby defining an open portion in the total width of the fluid flow path, and each mesh assembly being further configured such that bubbles in the fluid are conveyed across the mesh assemblies and through the open portion away from the ejection assembly.

18. The fluid dispenser of claim 17, wherein each mesh assembly is additionally configured to define a plurality of fluid passageways having a geometry selected both to permit fluid flow therethrough toward the ejection assembly and to restrain a substantial portion of any particles in the fluid from flowing therethrough toward the ejection assembly.

19. The fluid dispenser of claim 18, wherein the fluid passageways have a substantially similar shape.

20. The fluid dispenser of claim 18, wherein the geometry of the fluid passageways is selected to be one of substantially rectangular and substantially hexagonal.

21. The fluid dispenser of claim 17, wherein the fluid includes an ink.

22. The fluid dispenser of claim 17, wherein the ejection assembly is configured to include a printhead.

23. The fluid dispenser of claim 17, wherein each mesh assembly is configured to include crenellations.

* * * * *

UNITED STATES PATENT AND TRADEMARK OFFICE

CERTIFICATE OF CORRECTION

PATENT NO. : 9,033,482 B2
APPLICATION NO. : 14/374117
DATED : May 19, 2015
INVENTOR(S) : Arun Agarwal et al.

It is certified that error appears in the above-identified patent and that said Letters Patent is hereby corrected as shown below:

Claims

In column 7, line 58, in Claim 5, delete "laid" and insert -- fluid --, therefor.

Signed and Sealed this
Twenty-fourth Day of May, 2016

Michelle K. Lee

Michelle K. Lee
*Director of the United States Patent and Trademark Office*